US006280314B1

(12) United States Patent
Yamagishi et al.

(10) Patent No.: US 6,280,314 B1
(45) Date of Patent: Aug. 28, 2001

(54) COIN DISPENSING DEVICE

(75) Inventors: Ryoji Yamagishi, Kawagoe; Nobuyuki Iida, Sakado; Yasushi Onodera, Iwate, all of (JP)

(73) Assignee: Kabushiki Kaisha Nippon Conlux, Tokyo (JP)

( * ) Notice: Subject to any disclaimer, the term of this patent is extended or adjusted under 35 U.S.C. 154(b) by 0 days.

(21) Appl. No.: 09/623,111

(22) PCT Filed: Jan. 27, 2000

(86) PCT No.: PCT/JP00/00397

§ 371 Date: Aug. 25, 2000

§ 102(e) Date: Aug. 25, 2000

(87) PCT Pub. No.: WO00/45345

PCT Pub. Date: Aug. 3, 2000

(30) Foreign Application Priority Data

Jan. 27, 1999 (JP) ..... 11-018590

(51) Int. Cl.[7] ..... G07D 1/00

(52) U.S. Cl. ..... 453/44; 453/21; 453/23; 453/24; 453/37; 453/41; 221/272; 221/273

(58) Field of Search ..... 453/21, 23, 24, 453/37, 41, 44; 221/215, 272, 273

(56) References Cited

U.S. PATENT DOCUMENTS

| | | | | |
|---|---|---|---|---|
| 0,823,225 | * | 6/1906 | McKenzie . | |
| 1,390,587 | * | 9/1921 | Rohwer . | |
| 1,656,306 | * | 1/1928 | Tratsch . | |
| 2,661,827 | * | 12/1953 | Munz et al. | 194/9 |
| 2,830,549 | * | 4/1958 | Troll | 112/113 |
| 3,220,530 | * | 11/1965 | Offutt | 194/10 |
| 3,366,127 | * | 1/1968 | Breitenstein et al. | 133/4 |
| 4,171,753 | * | 10/1979 | Vreede | 221/197 |
| 4,281,755 | * | 8/1981 | Levine | 194/1 J |
| 4,284,093 | * | 8/1981 | Hayashi | 133/4 A |
| 4,326,550 | * | 4/1982 | Mochizuki et al. | 133/2 |
| 4,559,958 | * | 12/1985 | Wingerter | 133/4 |
| 4,606,362 | * | 8/1986 | Kobayashi et al. | 133/5 R |
| 4,792,057 | * | 12/1988 | Mizer et al. | 221/187 |
| 4,854,478 | * | 8/1989 | Gyimothy | 221/202 |
| 5,329,459 | * | 7/1994 | Kaufman et al. | 364/479 |
| 5,330,384 | * | 7/1994 | Shapley et al. | 453/17 |
| 5,415,321 | * | 5/1995 | Gehlert et al. | 221/68 |
| 5,460,471 | * | 10/1995 | Connor et al. | 414/412 |
| 5,657,833 | * | 8/1997 | Freeman | 184/18 |
| 5,868,235 | * | 2/1999 | Schwarzli | 194/212 |
| 6,039,165 | * | 3/2000 | Wild | 194/217 |
| 6,099,401 | * | 8/2000 | Perkitny | 453/9 |

FOREIGN PATENT DOCUMENTS

| | | | |
|---|---|---|---|
| 362941 | * | 8/1962 | (CH) . |
| 1294727 | * | 5/1969 | (DE) . |
| 142326/1989 | | 8/1991 | (JP) . |
| 4-35971 | | 8/1992 | (JP) . |
| 56398/1991 | | 2/1993 | (JP) . |
| 092770043 | | 10/1997 | (JP) . |

* cited by examiner

*Primary Examiner*—Christopher P. Ellis
*Assistant Examiner*—Jeffrey A. Shapiro
(74) *Attorney, Agent, or Firm*—Welsh & Katz, Ltd.

(57) ABSTRACT

A cam groove in a shuttling mechanism for shuttling a slide piece is formed into a generally S-shape, in order to provide a long shuttling distance of the slide piece which dispenses one by one coins stacked and stored in a coin tube, without sizable design changes of component parts.

2 Claims, 5 Drawing Sheets

COIN DISPENSING DEVICE

TECHNOLOGICAL FIELD

The present invention relates to improvements of a coin dispensing device for dispensing coins according to the amount of change from a detachably mounted cassette type coin tube.

BACKGROUND ART

Generally, a device such as a vending machine is equipped with a coin processing device for discriminating the genuineness of input coins and dispensing coins according to the amount of change.

This coin processing device generally comprises the following two devices:

(1) Coin sorting device that discriminates the truth or false of input coins and returns false coins, and discriminates the denominations of true coins and sorts them according to the denominations.

(2) Coin dispensing device that accommodates true coins sorted by the coin sorting device according to denominations and dispenses coins according to the amount of change.

Among them, the coin dispensing device comprises a detachably mounted cassette type coin tube for stacking and storing and accommodating coins of a specific denomination, and a coin dispensing unit for dispensing coins from the bottom face of the coin tube.

FIG. 3 is a schematic perspective view showing the aforementioned coin dispensing device 1.

Unlike a so-called plural denomination coin dispensing device that accommodates coins of a plurality of denominations and selects and dispenses coins of specific denominations according to the amount of change among them, the coin dispensing device 1 shown in FIG. 3 accommodates and dispenses only frequently used coins. The coin dispensing device 1 of this type is generally arranged in the neighborhood of the plural denomination coin dispensing device for dispensing coins of a plurality of denominations.

The coin dispensing device 1 comprises a cassette type coin tube 2 which can be freely mounted and dismounted, for accommodating only frequently used coins, and a coin dispensing means 4 for dispensing a number of coins 3 stacked and stored in the coin tube 2 one by one from the lowest one.

The coin dispensing means 4 comprises a slide piece 7 shuttling in the direction of the arrow A along a guide groove 6 of a coin base 5 arranged at the lowest part of the coin tube 2 and a shuttling means 8 for shuttling the slide piece 7.

By using this coin dispensing means 4, when the slide piece 7 moves in the direction of the arrow A by the shuttling means 8, a guiding projection 7*a* of the slide piece 7 and the coin 3 located at the lowest position among the coins accommodated in the coin tube 2 come into contact with each other.

When the slide piece 7 moves more in the direction of the arrow A, as shown in FIG. 4, the coin 3 located at the lowest position and being contact with the guiding projection 7*a* is ejected from the coin tube 2, drops downward along a main base plate 9 of the coin dispensing device 1, and is dispensed to a coin dispensing opening not shown in the drawing.

Numeral 10 shown in FIGS. 3 and 4 indicates a guide hole which is formed in the back of the coin tube 2 and in which the guiding projection 7*a* is inserted, and 11 indicates a coin dispensing hole formed in the front of the coin tube 2.

On the other hand, the shuttling means 8, comprises a drive motor 12 as shown in FIG. 4, and a cam mechanism for converting the rotational force of the drive motor 12 to shuttling linear motion of the slide piece 7 which will be described hereunder.

FIG. 5 is a bottom view of the slide piece 7 showing the cam mechanism of the conventional shuttling means 8 mentioned above.

The cam mechanism, as shown in FIG. 5(*a*), comprises a rotation plate 21 fixed to the tip end of a rotation shaft 12*a* of the drive motor 12 (FIG. 4), a cam shaft 22 which is a cylindrical cam projected on the top face of the tip end of the rotation plate 21, and a cam groove 23 formed in a bottom face 7*a* of the slide piece 7 in which the cam shaft 22 is inserted.

Conventionally, the cam groove 23 is formed linearly at right angles to the shuttling direction (the arrow A) of the slide piece 7. Numeral 7*b* shown in FIG. 5(*a*) indicates the tip end of the slide piece 7.

By use of the shuttling means 8 having such a cam mechanism, when the drive motor 12 (FIG. 4) is driven and the rotation shaft 12*a* starts rotation counterclockwise from the initial position of a rotation angle of 0 degree as shown in FIG. 5(*a*), the cam mechanism 23 moves following the rotation of the cam shaft 22, and the slide piece 7 slides backward to the farthest backward position when the rotation angle of the rotation shaft 12*a* is 180 degrees as shown in FIG. 5(*b*). When the rotation angle of the rotation shaft 12*a* becomes 360 degrees, the slide piece 7 slides forward to the farthest forward position as shown in FIG. 5(*c*).

As described above, by use of this conventional shuttling means 8, the slide piece 7 shuttles by the distance L in the direction of the arrow A as shown in FIGS. 5(*b*) and 5(*c*), and during the period, the slide piece 7 is contact with the coin 3 accommodated in the coin tube 2, moves the coin 3 by a distance corresponding to the shuttling distance L, and dispenses it from the coin tube 2 as shown in FIGS. 3 and 4.

The alternate long and short dash line F shown in FIG. 5 is a reference line passing the center Oa of the rotation shaft 12*a*.

Meanwhile, according to the aforementioned coin dispensing device 1, as shown in FIG. 4, to dispense the coin 3 accommodated in the coin tube 2, it is necessary to change the shuttling distance L of the slide piece 7 shown in FIGS. 5(*b*) and 5(*c*) according to the diameter of the accommodated coin 3. Especially, when the coin 3 to be dispensed has a large diameter, it is necessary to secure the long shuttling distance L of the slide piece 7 accordingly.

However, according to the aforementioned coin dispensing device 1 having the conventional shuttling means 8, to increase the shuttling distance L of the slide piece 7 shown in FIG. 5, it is necessary to increase the distance X from the rotation center Oa of the rotation shaft 12*a* to the center Ob of the cam shaft 22 as shown in FIG. 5(*a*), and change the forming position of the cam groove 23 according to the increase of the distance X. Accordingly, it is also necessary to change the distance Y from the center Ob of the cam shaft 22 to the fore end 7*b* of the slide piece 7.

Furthermore, when the distance X from the rotation center Oa of the rotation shaft 12*a* to the center Ob of the cam shaft 22 is increased, to maintain the contact of the cam groove 23 with the cam shaft 22, it is also necessary to increase the length of the cam groove 23 accordingly and hence it is also necessary to increase the width W of the slide piece 7.

Therefore, in the coin dispensing device 1 having the conventional shuttling means 8, when it is attempted to secure the long shuttling distance L of the slide piece 7 in correspondence with dispensing of coins with a large diameter, it is necessary to greatly change the design of each component parts and hence there are disadvantages that not only the manufacturing cost is unavoidably increased but also the coin dispensing device becomes large.

The present invention has been developed with the foregoing in view and is directed to provide a coin dispensing device for increase the shuttling distance of the slide piece at the time of dispensing of coins without greatly changing the design of each component part.

DISCLOSURE OF THE INVENTION

To solve the above problems, according to the present invention, in a coin dispensing device having shuttling means comprising a cam for converting rotating motion of a rotation shaft to linear shuttling motion and a cam groove and a slide piece shuttling by means of the shuttling means, whereby a coin located on the lowest position among coins stacked and stored in the coin tube is successively dispensed by the shuttling slide piece, wherein the cam groove of the shuttling means is formed substantially in an S-shape perpendicularly to direction of the shuttling motion of the slide piece.

BEST MODE FOR CARRYING OUT OF THE INVENTION

An embodiment of a coin dispensing device of the present invention will be described hereunder in detail.

Figures 1A, 1B, 1C, 1D, 1E:
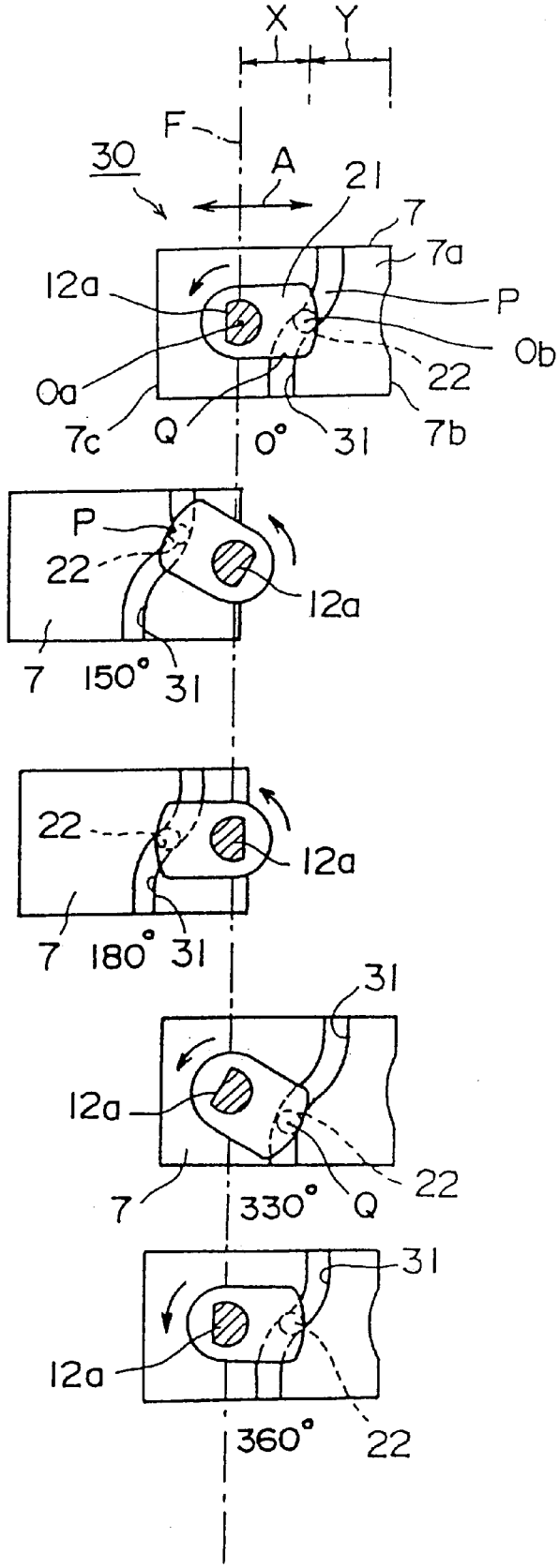
FIG. 1 is bottom views of a slide piece showing a shuttling means of a coin dispensing device of the present invention.
Figure 5A:
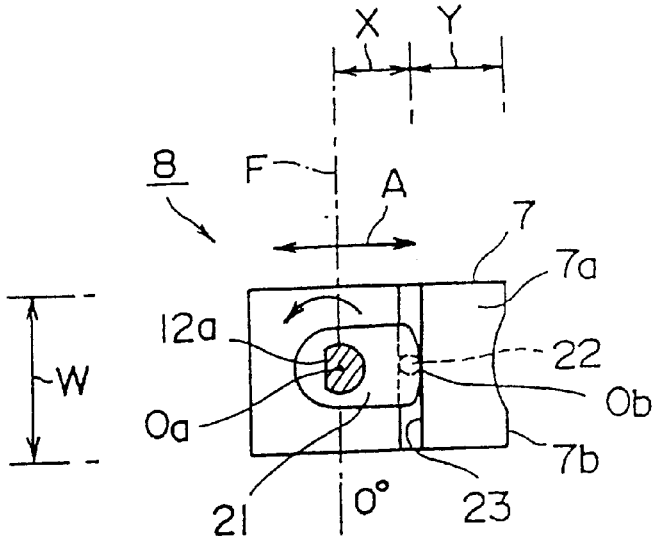
FIG.5(a) PRIOR ART
FIG. 5 is bottom views of a slide piece showing a shuttling means of a conventional coin dispensing device.
Figure 5B:
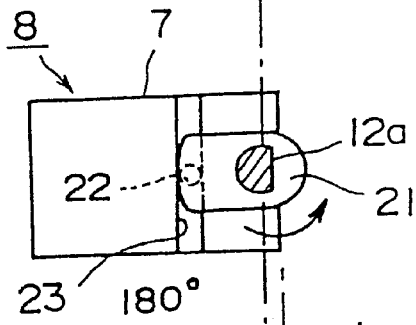
FIG.5(b) PRIOR ART
Figure 5C:
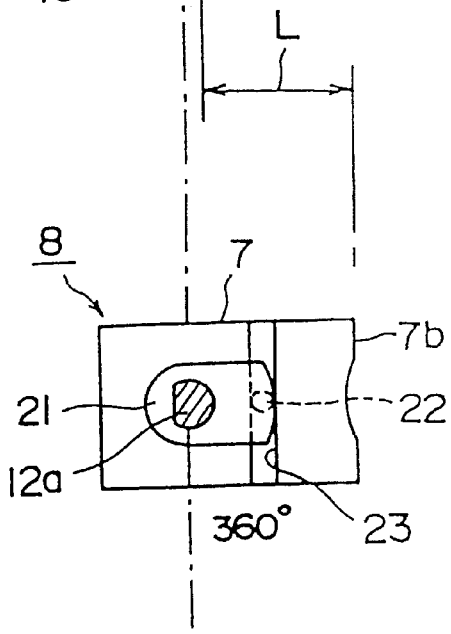
FIG.5(c) PRIOR ART

FIG. 1 is a bottom view of the slide piece 7 showing a shuttling means 30 of a coin dispensing device of the present invention and the same numeral is assigned to each of the same parts as those shown in FIG. 5.

The shuttling means 30 shown in FIG. 1 and the shuttling means 8 shown in FIG. 5 have exactly the same shape and size except that the shape of a cam groove 31 of the cam mechanism for converting the rotation of the rotation shaft 12*a* to shuttling linear motion is different.

The cam mechanism of the shuttling means 30, as shown in FIG. 1(*a*), comprises, in the same way as with the conventional one, a rotation plate 21 fixed to the tip end of a rotation shaft 12*a* of a drive motor 12, a cylindrical cam shaft 22 projected on the top face of the tip end of the rotation plate 21, and a cam groove 31 formed in a bottom face 7*a* of a slide piece 7 in which the cam shaft 22 is fit and inserted and only the shape of the cam groove 31 is greatly different from the conventional one and formed substantially in an S-shape perpendicularly to the shuttling direction (the arrow A) of the slide piece 7.

The cam groove 31 substantially in an S-shape has two inflection points P and Q in the vertical direction. The outer part (the upper side in the drawing) of the cam groove 31 from one inflection point P positioned on the side of the fore end 7*b* of the slide piece 7 is linearly formed perpendicularly to the shuttling direction (the arrow A) of the slide piece 7, and the outer part (the lower side in the drawing) of the cam groove 31 from the other inflection point Q formed on the side of the back end 7*c* of the slide piece 7 is also linearly formed perpendicularly to the shuttling direction (the arrow A) of the slide piece 7.

An alternate long and short dash line F shown in FIG. 1 is a reference line passing the center Oa of the rotation shaft 12*a* in the same way as with the conventional one.

Next, the operation of the shuttling means 30 will be explained.

Figure 4:
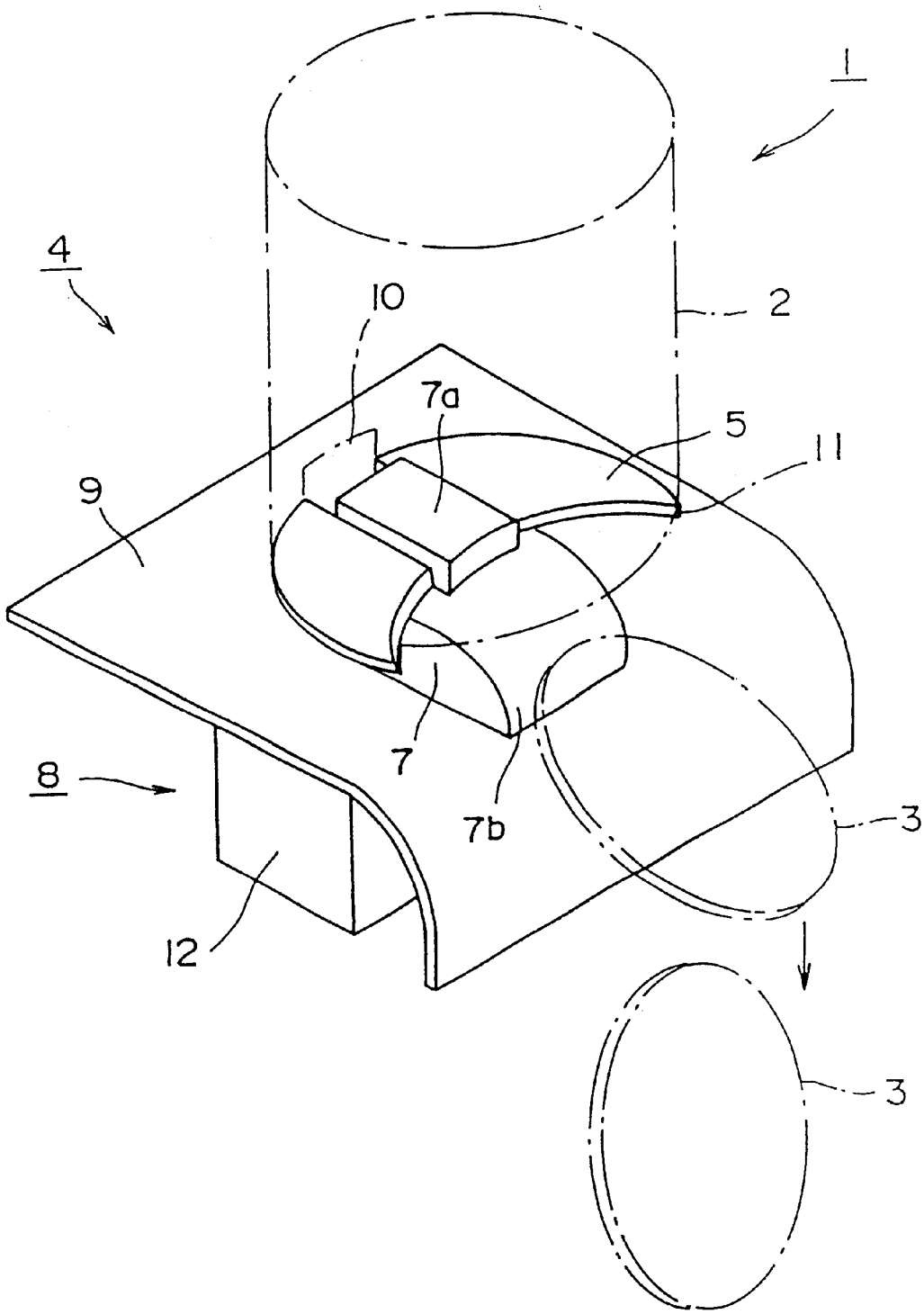
FIG. 4 is a schematic perspective view showing the operation of a coin dispensing device.

With the shuttling means 30 having the cam groove 31 substantially in an S-shape, when the drive motor 12 (FIG. 4) is driven and the rotation shaft 12*a* starts rotation counterclockwise from the initial position of a rotation angle of 0° shown in FIG. 1(*a*), the cam mechanism 31 moves following the rotation of the cam shaft 22 so that the rotation angle of the rotation shaft 12*a* reaches 150 degrees and the cam shaft 22 reaches the inflection point P of the cam groove 31. At that time, the slide piece 7 slides backward to the farthest backward position as shown in FIG. 1(*b*).

As the rotation shaft 12*a* continues rotation and the rotation angle reaches 180 degrees, the slide piece 7 reaches the position shown in FIG. 1(*c*).

Furthermore, when the rotation shaft 12*a* rotates from the position shown in FIG. 1(*c*) and the rotation angle reaches 330 degrees, the cam shaft 22 reaches the inflection point Q of the cam groove 31 and at that time, the slide piece 7 slides forward to the farthest forward position as shown in FIG. 1(*d*).

When the rotation angle of the rotation shaft 12*a* reaches 360 degrees, the slide piece 7 reaches the position shown in FIG. 1(*e*).

The initial position of the slide piece 7 where the rotation angle of the rotation shaft 12*a* is 0 degree as shown in FIG. 1(*a*) is the same as the initial position of the slide piece 7 at a rotation angle of 0 degrees in the conventional shuttling means 8 shown in FIG. 5(*a*). The retracted position of the slide piece 7 at a rotation angle of 180 degrees of the rotation shaft 12*a* shown in FIG. 1(*c*) is also the same as the retracted position of the slide piece 7 at a rotation angle of 180 degrees of the rotation shaft 12*a* shown in FIG. 5(*b*). Furthermore, the forward position of the slide piece 7 at a rotation angle of 360 degrees of the rotation shaft 12*a* shown in FIG. 1(*e*) is also exactly the same as the forward position of the slide piece 7 at a rotation angle of 360 degrees of the rotation shaft 12*a* shown in FIG. 5(*c*).

Now, the farthest forward position of the slide piece 7 by the shuttling means 8 of the present invention shown in FIG. 1(*d*) is compared with the farthest forward position of the slide piece 7 by the conventional shuttling means 8 shown in FIG. 5(*c*).

Figure 2A:
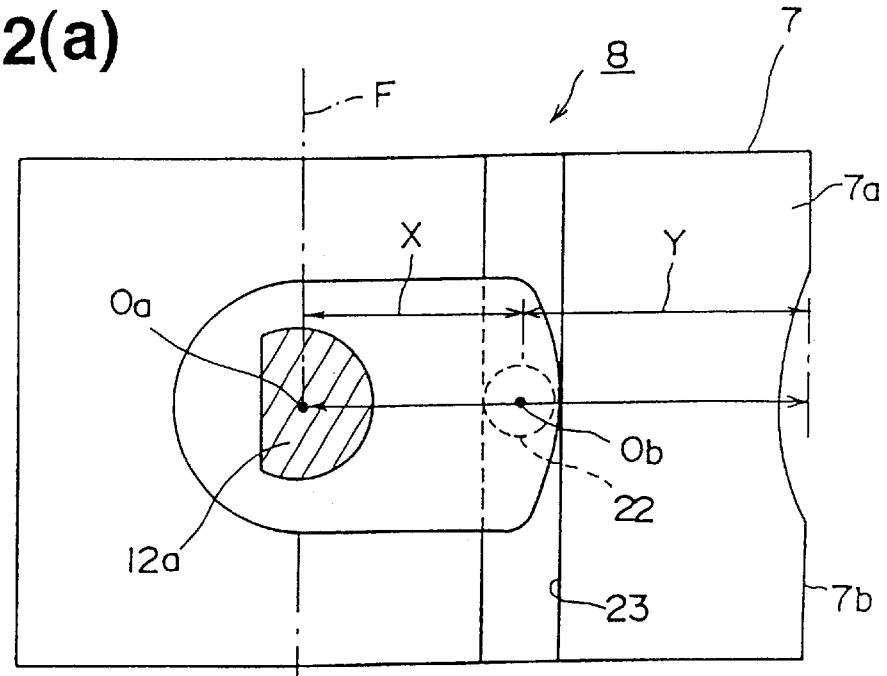
FIG. 2 is enlarged bottom views of a slide piece in which a shuttling means of a coin dispensing device of the present invention and a conventional shuttling means are compared.
Figure 2B:
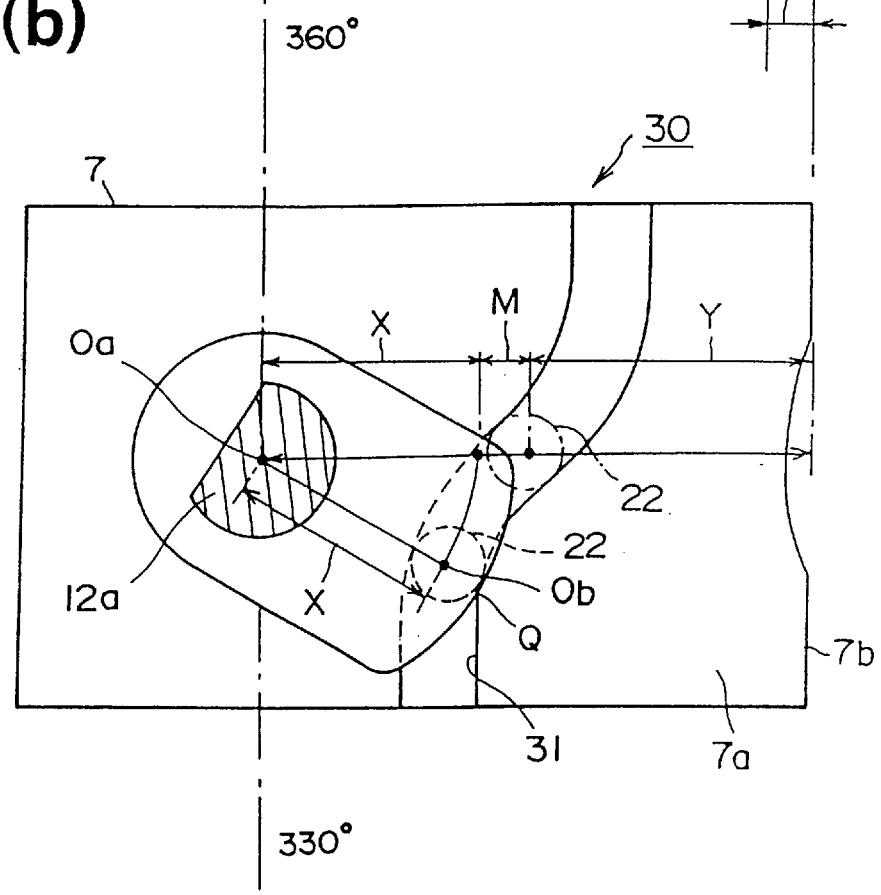
Figure 3:
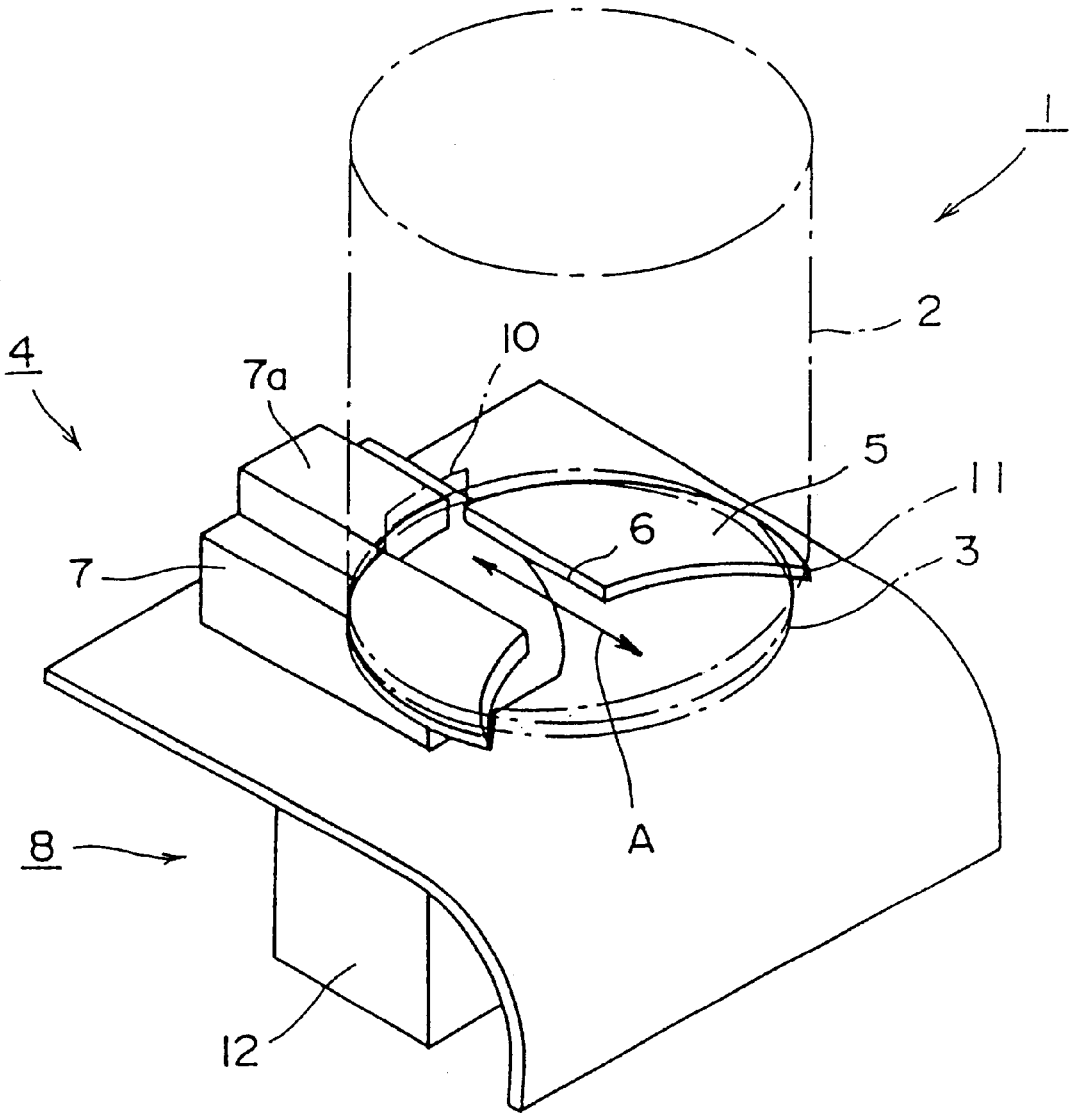
FIG. 3 is a schematic perspective view of a coin dispensing device.

FIG. 2(*a*) is an enlarged view of the slide piece 7 showing the farthest forward position of the slide piece 7 by the conventional shuttling means 8 shown in FIG. 5(*c*), and FIG. 2(*b*) is an enlarged view of the slide piece 7 showing the farthest forward position of the slide piece 7 by the shuttling means 30 of the present invention shown in FIG. 1(*d*).

The position movements of the slide pieces 7 are compared assuming that the distance from the rotation center Oa of the rotation shaft 12*a* to the rotation center Ob of the cam shaft 22 is X and the distance from the rotation center Ob of the cam shaft 22 to the fore end 7*b* of the slide piece 7 at that time is Y As shown in FIG. 2(*a*), when the conventional shuttling means 8 is used, the fore end 7*b* of the slide piece 7 advances from the reference line F to the position of X+Y On the other hand, as apparent from the positional relationship between the cam groove 31 and the cam shaft 22 shown in FIG. 2(*b*), according to the shuttling means 30 of the present invention, by the cam shaft 22 reaching the inflection point Q of the cam groove 31 substantially in an S-shape, the fore end 7*b* of the slide piece 7 advances by the distance M corresponding to the curved deformation of the cam groove 31. As a result, the fore end 7*b* of the slide piece 7 advances from the reference line F to the position of X+Y+M in total.

The advanced distance M of the slide piece 7 which is lengthened according to the curved deformation of the cam groove 31 takes place in the same manner when the slide piece 7 is retracted, that is, as shown in FIG. 1(*b*). Hence, with the slide piece 7 to which the shuttling means 30 of the present invention is applied, the shuttling distance can be lengthened by 2M compared with the slide piece 7 to which the conventional shuttling means 8 is applied.

Therefore, the shuttling means 30 of the present invention can dispense coins with a diameter larger by an amount corresponding to the advanced distance 2M by a simple design change of changing the shape of the cam groove 31 to substantially an S-shape.

In the aforementioned embodiment, the shuttling means 30 is applied to the slide piece 7 for dispensing coins of one denomination. However, the present invention is not limited to the aforementioned embodiment, but it may also be applied to a cam groove of the shuttling means of a slide piece for dispensing coins of plural denominations at the same time. As explained above, according to the coin dispensing device of the present invention, the cam groove of the shuttling means for shuttling the slide piece is formed substantially in an S-shape. With such a construction, the shuttling distance of the slide piece can be lengthened according to the degree of curved deformation of the cam groove, and hence by a simple design change of only changing the cam groove shape to substantially an S-shape without greatly changing the design of each component parts, a coin dispensing device for the diameter of coins of various denominations to be dispensed can be provided at an extremely low cost.

INDUSTRIAL APPLICABILITY

The present invention is suitable for a coin dispensing device which can dispense coins having various diameters, particularly coins of a large diameter without greatly changing the design of each component part.

What is claimed is:

1. A coin dispensing device having shuttling means comprising a cam for converting rotating motion of a rotation shaft to linear shuttling motion and a cam groove and a slide piece shuttling by means of the shuttling means, whereby a coin located on the lowest position among coins stacked and stored in the coin tube is successively dispensed by the shuttling slide piece, characterized in that:

the cam groove of the shuttling means is formed substantially in an S-shape perpendicularly to direction of the shuttling motion of the slide piece.

2. A coin dispensing device according to claim 1, wherein the shuttling means comprises a drive motor, a rotation plate fixed to a tip end of the rotation shaft of the drive motor, and a cylindrical cam shaft which is projected on a top face of the rotation plate and inserted into the cam groove substantially in an S-shape which is formed in the slide piece.

* * * * *